US012781748B2

(12) United States Patent
Mcivor

(10) Patent No.: US 12,781,748 B2
(45) Date of Patent: Nov. 3, 2026

(54) IN-LINE PUMPING APPARATUS, SYSTEM, AND METHOD FOR INCREASING LIQUID FLOW IN GRAVITY NETWORKS

(71) Applicant: INDUSTRIAL FLOW SOLUTIONS OPERATING LLC, New Haven, CT (US)

(72) Inventor: Graham Mcivor, New Haven, CT (US)

(73) Assignee: Industrial Flow Solutions Operating, LLC, New Haven, UT (US)

( * ) Notice: Subject to any disclaimer, the term of this patent is extended or adjusted under 35 U.S.C. 154(b) by 0 days.

(21) Appl. No.: 19/032,433

(22) Filed: Jan. 20, 2025

(65) Prior Publication Data

US 2025/0163918 A1 May 22, 2025

Related U.S. Application Data

(63) Continuation-in-part of application No. 18/587,191, filed on Feb. 26, 2024, now Pat. No. 12,203,476,
(Continued)

(51) Int. Cl.
*F04D 15/02* (2006.01)
*E03F 5/22* (2006.01)
(Continued)

(52) U.S. Cl.
CPC ..... *F04D 15/0218* (2013.01); *E03F 5/22* (2013.01); *F04D 13/06* (2013.01); *F04D 13/12* (2013.01); *F04D 13/14* (2013.01); *F04D 15/0066* (2013.01); *F04D 15/0072* (2013.01); *F04D 15/0088* (2013.01); *F04D 15/0209* (2013.01);
(Continued)

(58) Field of Classification Search
CPC ..... F04D 15/0218; F04D 13/06; F04D 13/12; F04D 13/14; F04D 15/0066; F04D 15/0072; F04D 15/0088; F04D 15/0209; F04D 15/029; F04D 29/2283; F04D 29/708;
(Continued)

(56) References Cited

U.S. PATENT DOCUMENTS 2,347,544 A * 4/1944 De Costa ..... E03F 5/22 210/111
2,421,066 A * 5/1947 Howe ..... E03F 5/22 417/30

(Continued)

*Primary Examiner* — Peter J Bertheaud
(74) *Attorney, Agent, or Firm* — Wasserbauer Law, LLC; Damian G. Wasserbauer, Esq.; Nicholas E. Blanton, Esq.

(57) ABSTRACT

The invention provides a liquid pumping apparatus, system and method for increasing the flow of fluid in a gravity feed network. The invention provides an in-line main pipe with upstream and downstream portions flanking a manifold that houses a check valve. One or more branch pipes may form a fluid bypass around the manifold. Each branch pipe includes a pump configured to accelerate the fluid in at least partially the same direction as the downstream flow. A sensor may be adapted to measure a parameter related to the liquid level in the main pipe. A rotary encoder may be adapted to measure the flow rate in the main pipe as a proportional function of the check valve angle, under gravity flow conditions. A control system may energize the pumps when the liquid level in the main pipe is above a predetermined threshold according to the parameter.

8 Claims, 6 Drawing Sheets

Related U.S. Application Data which is a continuation of application No. 17/642,657, filed on Mar. 11, 2022, now Pat. No. 11,982,280, which is a continuation of application No. PCT/US2019/063767, filed on Nov. 27, 2019.

(60) Provisional application No. 62/904,652, filed on Sep. 23, 2019.

(51) Int. Cl.

| | |
|---|---|
| ***F04B 23/04*** | (2006.01) |
| ***F04B 49/02*** | (2006.01) |
| ***F04B 49/06*** | (2006.01) |
| ***F04D 13/06*** | (2006.01) |
| ***F04D 13/12*** | (2006.01) |
| ***F04D 13/14*** | (2006.01) |
| ***F04D 15/00*** | (2006.01) |
| ***F04D 29/22*** | (2006.01) |
| ***F04D 29/70*** | (2006.01) |

(52) U.S. Cl.

CPC ..... *F04D 15/029* (2013.01); *F04D 29/2283* (2013.01); *F04D 29/708* (2013.01); *F04B 23/04* (2013.01); *F04B 49/02* (2013.01); *F04B 49/065* (2013.01); *F04B 2203/0209* (2013.01)

(58) Field of Classification Search

CPC .. E03F 5/22; F04B 23/04; F04B 49/02; F04B 49/065; F04B 2203/0209

See application file for complete search history.

(56) References Cited

U.S. PATENT DOCUMENTS

| | | | | |
|---|---|---|---|---|
| 2,701,026 | A * | 2/1955 | Howe | E03F 5/22 137/115.02 |
| 2,739,662 | A * | 3/1956 | Sofia | E03F 5/22 210/111 |
| 6,273,684 | B1 * | 8/2001 | Jensen | H01H 35/405 417/43 |
| 8,313,305 | B2 * | 11/2012 | Bevington | F04B 49/002 417/43 |
| 9,726,179 | B2 * | 8/2017 | Dumonceaux | F04D 7/045 |
| 11,982,280 | B2 * | 5/2024 | Dumonceaux | F04D 7/045 |
| 12,203,476 | B2 * | 1/2025 | Dumonceaux | F04D 15/0088 |
| 2020/0063741 | A1 * | 2/2020 | Lechner | F04D 29/426 |

* cited by examiner

IN-LINE PUMPING APPARATUS, SYSTEM, AND METHOD FOR INCREASING LIQUID FLOW IN GRAVITY NETWORKS

CROSS-REFERENCE TO RELATED APPLICATIONS

This application is a continuation-in-part of, and claims the benefit of, U.S. patent application Ser. No. 18/587,191 filed on Feb. 26, 2024, now U.S. Pat. No. 12,203,476, entitled "In-Line Pumping Apparatus, System, And Method For Increasing Liquid Flow In Gravity Networks," which in turn claims the benefit of U.S. patent applicant Ser. No. 17/642,657 filed on Mar. 11, 2022, now U.S. Pat. No. 11,982,280, entitled "In-Line Pumping Apparatus, System And Method For Increasing Liquid Flow In Gravity Networks," which in turn claims the benefit of PCT/US19/63767 filed on Nov. 27, 2019, entitled "In-Line Pumping Apparatus, System And Method For Increasing Liquid Flow In Gravity Networks," which in turn claims the benefit of U.S. Provisional Patent Application No. 62/904,652 filed on Sep. 23, 2019, entitled Apparatus, System and Method Of Gravity Fluid Accelerator With Wastewater Pump Having Shredder," each of which is incorporated by reference in its entirety herein.

TECHNICAL FIELD

The invention relates to the technical field of pumping liquids in pipes and, in particular, to a pumping apparatus, system and method for increasing the flow of liquid in a gravity feed network. The invention provides advantages in installation within a shallow dry well and monitoring of the gravity induced flow.

BACKGROUND

Installed wastewater drainage systems in cities, towns and rural areas using a gravity feed design can reach maximum capacity and overflow conditions. Most gravity feed designs utilize a submerged pumping device in a tank and/or wet well. When the pumping device has a failure, its repair imposes a complete interruption of the pumping, drainage of the tank, and additional costs. Some installations utilize another backup pumping device or second pumping station that is also an additional cost.

There is a need for a solution to increase capacity of existing gravity feed designs in a cost effective way. Gravity feed infrastructure can reach maximum capacity of the flow of liquid due to increased precipitation, rains, floods, and other environmental conditions in short amounts of time that overloads the system. For example, a rainwater discharge pipe of a parking surface of the same size, dimensioned for a flow rate corresponding to a so-called downtime frequency precipitation, will not be able to evacuate more fluids in the event of higher precipitation. This, in turn, may cause the parking lot to flood as long as the precipitation intensity remains high. Similarly, a wastewater collector sized for a maximum number of simultaneous users must be replaced by a higher and/or larger section of pipe if, even for a limited period of time, the population connected to this wastewater collector exceeds this maximum number of simultaneous users, for example, high volume used in tourist areas. Conventionally, infrastructure replacement solutions to increase the maximum capacity of the flow of liquid in a pipe seek to increase the cross-sectional area of the pipes of the gravity feed network. Currently there are no solutions for gravity sewage pipe designs for increasing the maximum flow without increasing the internal section area of the gravity pipe and/or varying other factors such as slope and coefficient of resistance.

Another issue with installed gravity feed networks is that they often include a plurality of shallow dry wells for accessing the pipes and/or pumps therein. Standard upright pump systems require that the well be dug deeper into the ground; otherwise, the pump may be too tall to be used as in-line pumping solutions. A deeper well typically adds cost and/or complexity to a project, which is undesirable. For retrofit applications, therefore, it is desirable and advantageous to increase the instantaneous capacity of the gravity feed main line, a liquid pumping apparatus that can fit into small, shallow wells.

It would also be operationally advantageous to know the flow rate within a wastewater line without introducing obstructions that may cause solids to block the pipe.

Consequently, there is a long-felt need for a solution to increase the flow of liquids on demand in gravity feed networks so as to process wastewater and large amounts of precipitation in a short amount of time without clogging and without the need for costly infrastructure upgrades.

SUMMARY OF THE INVENTION

The invention provides a liquid pumping apparatus, system and method for increasing the flow of liquid in a gravity feed network. The invention provides an in-line main pipe adapted to directly connect an inlet pipe to an outlet pipe of the gravity feed network so as to pass liquid therethrough. The main pipe may comprise an upstream portion, a manifold and a downstream portion. One or more branch lines may form a bypass around the manifold. Each branch line may include an inlet branch pipe fluidly connecting the upstream portion to a pump and an outlet branch pipe fluidly connecting the pump to the downstream portion. A check valve may be operably disposed in the manifold and may be configured to prevent backflow from the outlet to the inlet. At least one sensor may be adapted to measure a parameter related to the liquid level in the main pipe. At least one sensor may be adapted to measure the flow rate in the main pipe. A controller may be electrically connected to the sensors and adapted to determine the condition of the main pipe and pumps and, based on that condition, calculate an appropriate operational mode and system setpoints. The controller may communicate the mode and setpoints to a control system electrically connected to each of the one or more pumps, where the control system adapted to energize the motor in the one or more pumps accordingly. In this way, when the liquid level in the main pipe is above a predetermined value, the pumps are energized.

It is a further object of the invention to provide an apparatus, system, and method to increase, and/or significantly increase, the maximum flow capacity of a pipe without increasing its internal cross-section or slope, or footprint of the well within which the apparatus sits. Among other issues, such a system would thereby avoid pipe realignment or replacement. In retrofit applications, such a system would thereby advantageously fit within the existing footprint of the well.

It is a further object of the invention to increase the flow within a pipe to pass solids, prevent clogging and to self-clean the pipe.

It is a further object of the invention to provide a liquid pumping apparatus that may be installed in a shallow dry well and provide clearance for the pump motors.

It is a further object of the invention to provide gravity induced flow sensing without adding internal structures that may obstruct and/or clog due to solids in the liquid.

It is a further object of the invention to provide remote sensing, control and management capabilities to save maintenance time and operational costs.

Other desirable features and characteristics will become apparent from the subsequent detailed description, the abstract, the drawings, and the appended claims, when considered in view of this background.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, which are incorporated in and constitute a part of this specification, show certain aspects of the subject matter disclosed herein and, together with the description, help explain some of the principles associated with the disclosed implementations, wherein.

DETAILED DESCRIPTION

Figure 1:
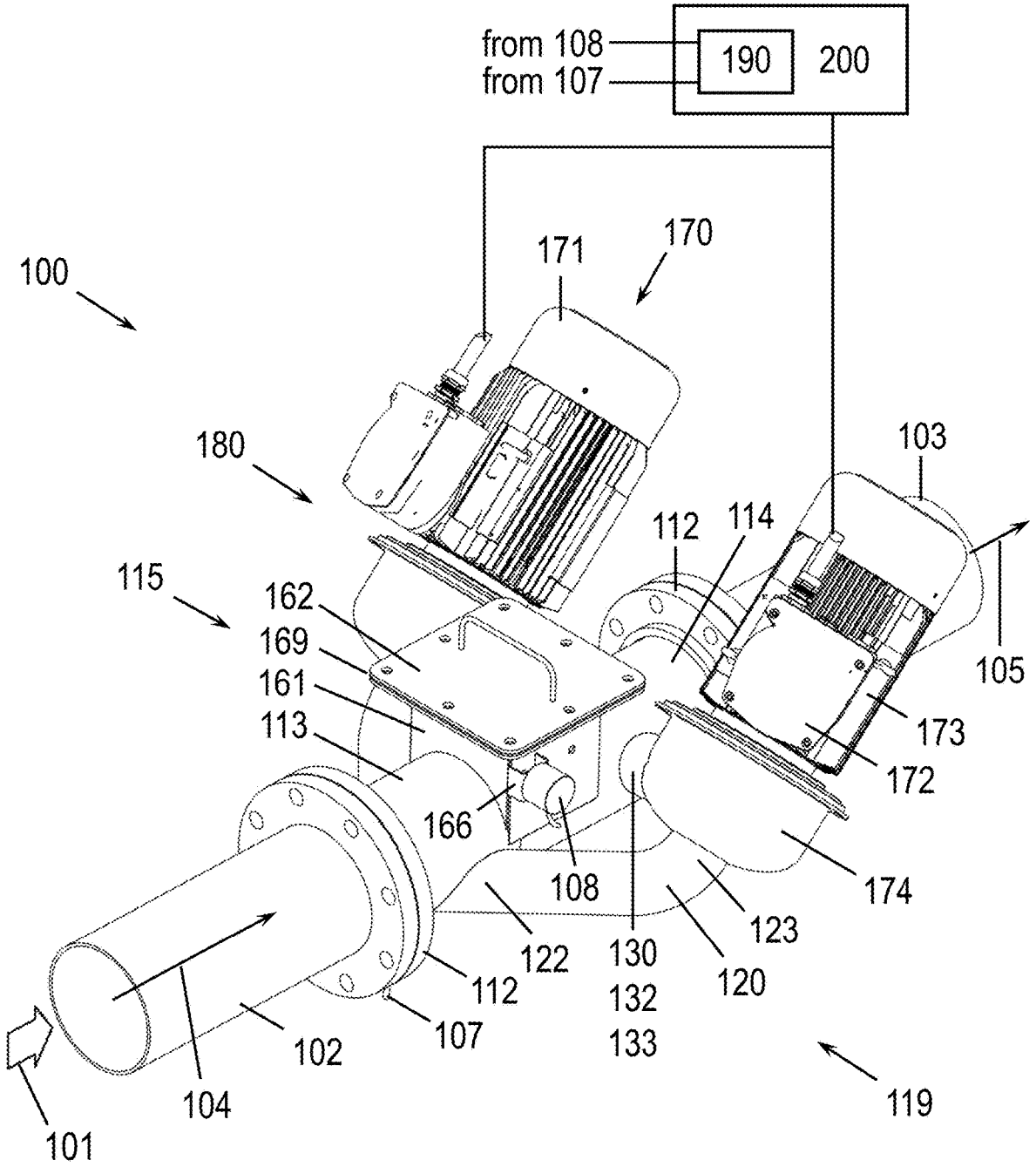
FIG. 1 is a perspective view of the liquid pumping apparatus, system, and method in accordance with an embodiment of the present invention.
Figure 2:
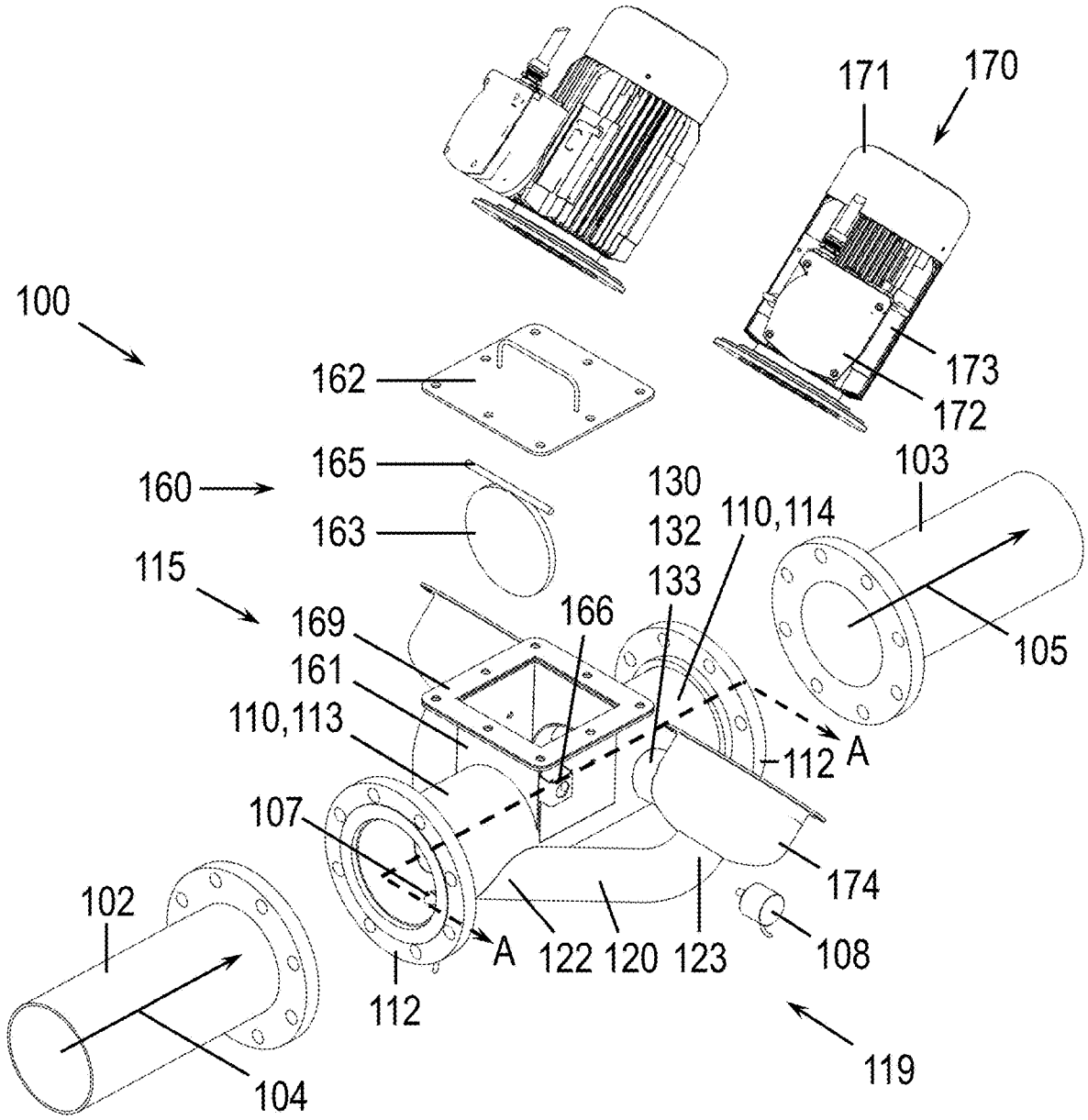
FIG. 2 is an exploded perspective view of the liquid pumping apparatus, system, and method in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As illustrated in FIGS. 1-6, a liquid pumping apparatus, system, and method is generally designated as element 100. The invention is described in the environment of an in-line pipe installation in a gravity feed network 101 and may be disposed between an inlet pipe 102 and outlet pipe 103. The gravity feed network 101 has an inlet flow 104 and outlet flow 105 of liquid from sources such as, for example, wastewater with fibrous solids, sediment, and/or other objects. The invention may be suitable for environments where the flow is to be accelerated using the features, structures, or characteristics of the liquid pumping apparatus and/or system 100 and may be combined without limitation in any suitable manner in one or more embodiments.

According to one or more embodiments of the present invention, with reference to FIGS. 1-4, the liquid pumping apparatus 100 may comprise a main pipe 110 with upstream 113 and downstream 114 portions flanking a manifold 115. The upstream 113 and downstream 114 portions may be terminated in flanges 112 configured to couple to the inlet 102 and outlet 102 of the wastewater network 101. A sensor 107 may be disposed in the upstream portion 113 and may be configured to measure pressure, level, flow rate and/or other desirable physical parameters. The manifold 115 may comprise a housing 161 adapted to enclose a check valve 160. The check valve 160 may comprise a disk 163 adapted for sealing the main pipe 110 against upstream flow and an axle 165 coupled to the disk 163 enabling rotation thereof. The housing 161 may be sealed against liquid egress by a cover 162 and a gasket 169. The housing 161 may further comprise a sensor bracket 166 configured to receive a rotary encoder 108 for sensing the rotation angle of the check valve 160. The liquid pumping apparatus 100 may further comprise one or more branch lines 119, each branch line forming a fluid bypass around the manifold 115. Each branch line 119 includes an inlet branch pipe 120 fluidly coupled at a first end 122 to the upstream portion 113 and at second end 123 to a pump body 174, and an outlet branch pipe 130 fluidly coupled at a third end 132 to the pump body 174 and at a fourth end 133 to the downstream portion 114.

Each branch line 119 may further comprise a pump 180, each pump comprising a pump body 174 and a motor 170, the motor 170 further comprising a housing 171, a control 172, and a sensor 173. The pump 180 may be of the self-clearing type, for example, such as a reversible type pump 180. Any self-cleaning type of pump 180 is considered as falling within the scope of this disclosure. The motor 170 can include one or more motor controls 172 and one or more sensors 173 for remote management by the control 190 and/or control system 200 thereby saving on maintenance time and costs. According to an embodiment of the invention, a suitable solids handling reversible pump 180 is manufactured by BJM Pumps LLC, Old Saybrook, Connecticut, under the product name SVF Series having Vortex impellers for shredding of mud, raw sewage, viscous liquids, rags, wood chips and other solids, the SKG Series featuring RAD-AX® dual shredding designed to obliterate flushable wipes and other difficult solids in municipal and industrial wastewater applications, pumps featuring IP67 IE3 motors, and/or a reversible wastewater shredder pump.

A pump control system 200 such as a Variable Frequency Drive (VFD) may be operably connected to the one or more pumps 180 so as to operate, e.g. to start and stop the motor 170 depending on the liquid level in the main pipe 110, or to set the rotation direction of the motor 170 upon detection of a blockage condition by the sensor 173. A suitable control system 200 may be a VFD drive manufactured by Danfoss, USA, Baltimore, Maryland under product name VLT® brand. The VFD drive may further be configured to have multiple pump-dedicated control features and an intelligent operation capability that is adapted to, for example, optimize the liquid flow, protect the motor, and/or protect other equipment in the pumping apparatus and system 100.

Sensors 107, 108, 173 may be electrically coupled to a controller 190 configured to interpret the measured parameters as a liquid level, flow rate, pump blockage level and the like and operate the one or more pumps accordingly. The controller 190 may be in electrical communication with the pump control system 200. The controller 190 may be configured as a supervisory control and data acquisition (SCADA) system for gathering and analyzing real time data input from the pressure transducer 107, the rotary encoder 108, and other sensors used to monitor and control the liquid pumping apparatus and system 100. The control system 200 can be configured for remote control management for resetting, unclogging and monitoring to save on maintenance time and costs.

One or more shutoff valves 140 (not shown) may be inserted between the inlet 102 and upstream portion 113 and/or between the downstream portion 114 and outlet 103 and secured by flanges 112. The shutoff valves 140 may be configured to interrupt the inlet flow 104 from the outlet flow 105, such as for servicing, repair, and/or removal of the liquid pumping apparatus 100 by mechanically obstructing flow of the fluid into the main pipe 110.

Figure 3:
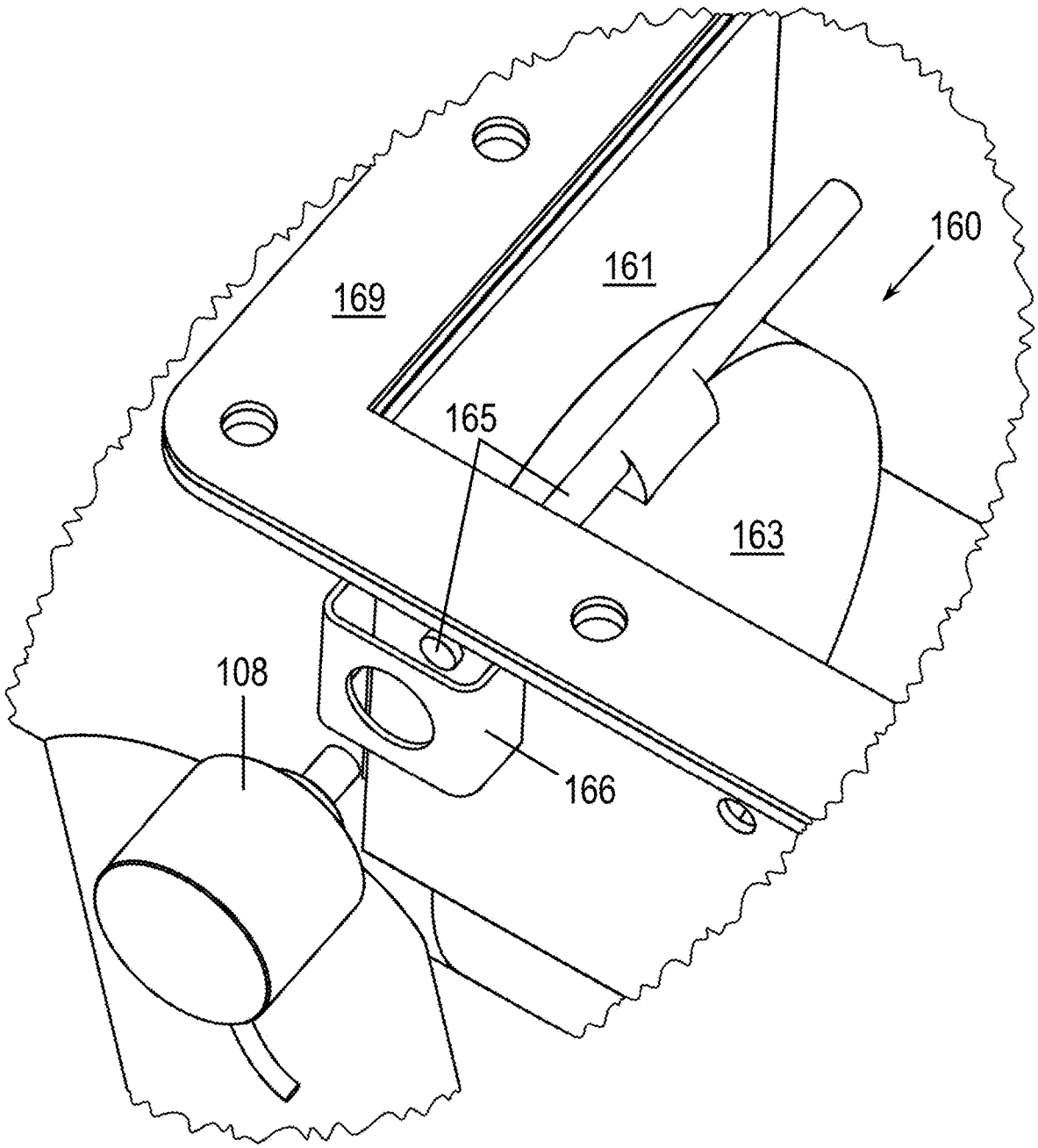
FIG. 3 is an enlarged, partial perspective view of the liquid pumping apparatus, showing details of a sensor bracket, rotary encoder, and check valve in accordance with an embodiment of the present invention.

FIG. 3 illustrates a partial, exploded perspective view of certain aspects of the rotary encoder 108. The axle 165 of the check valve 160 may pierce the housing 161 of the manifold 115 on the sensor bracket 166 side in a hermetic fashion. The bracket 166, which may comprise openings for coupling and/or fastening to the rotary encoder 108, may align the shaft of the rotary encoder 108 to the axle 165 of the check valve 160. The shaft of the rotary encoder 108 may be coupled to the check valve axle 165 such that they rotate together. The rotary encoder 108 may produce an analog signal proportional to the angle of the check valve 160. This information, along with the known diameter and slope of the main pipe 110, may be used by the controller 190 to calculate the flow rate within the main pipe 110 under gravity flow conditions. This information may be data logged by the controller 190 and/or remotely read and recorded through a system wide communications network. Advantageously, this apparatus and method of determining flow rate is non-obstructing as compared to a traditional, impeller, turbine or paddle wheel-based flow meter.

Figure 4:
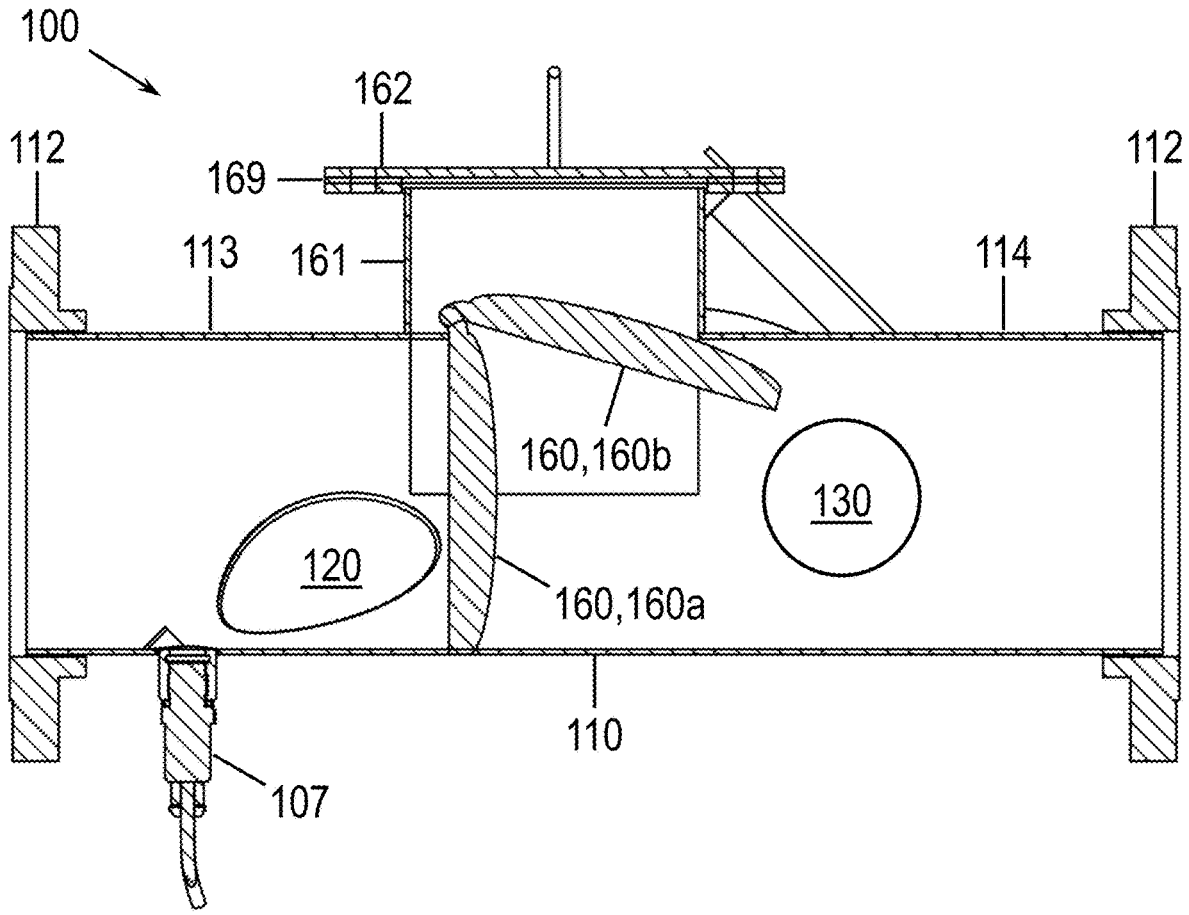
FIG. 4 is a section view of the pumping apparatus, system and method, taken along lines A-A of FIG. 2.

FIG. 4 illustrates a section view of the liquid pumping apparatus 100 (shown without the motor 180 for clarity) in which the operation of the check valve 160 may be seen. The check valve 160, which may be unbiased in a preferred embodiment, may operate between a closed position **160*a* and an open position 160*b*, inclusive. In certain alternative embodiments, the check valve 160 may be biased to at least partially open. In the closed position 160*a*, the check valve 160 may form a seal against the upstream portion 113 of the main pipe 110. The closed position 160*a* may thereby prevent reverse flow of the gravity fed liquid 101 from the downstream portion 114 to the upstream portion 113. In the open position 160*b*, the check valve 160** may allow flow in the downstream direction under the influence of gravity.

In normal operation, fluid flows from inlet 104 to outlet 105 under the influence of gravity, and the one or more pumps 180 are not energized, i.e., in an OFF configuration, so long as the inlet flow 104 remains under a predetermined threshold. However, under high flow conditions, such as for example after a rainstorm, the main pipe 110 diameter and the force of gravity may be insufficient to move the liquid through the network 101 to match the demand, which if left unabated would result in backup of the fluid in the network 101. Such a condition may be detected by the sensor 107, which measures a physical parameter such as pressure, flow, level or other desirable physical parameter. At a predetermined threshold of the one or more physical parameters to be sensed by sensor 107, the controller 190 signals the control system 200 to energize the one or more pumps 180 to an ON configuration. When the one or more pumps 180 are energized, fluid is drawn into the one or more inlet branch pipes 120 and expelled through the respective one or more outlet branch pipes 130, whereupon the flow reenters the main pipe 110 at the downstream portion 114. The downstream hydrostatic pressure may exceed the upstream hydrostatic pressure, and the check valve may respond by moving to the closed position **160*a*. In this way, the inflow 104 and outflow 105** may be accelerated until the flow rate falls below the predetermined threshold value.

Figure 5:
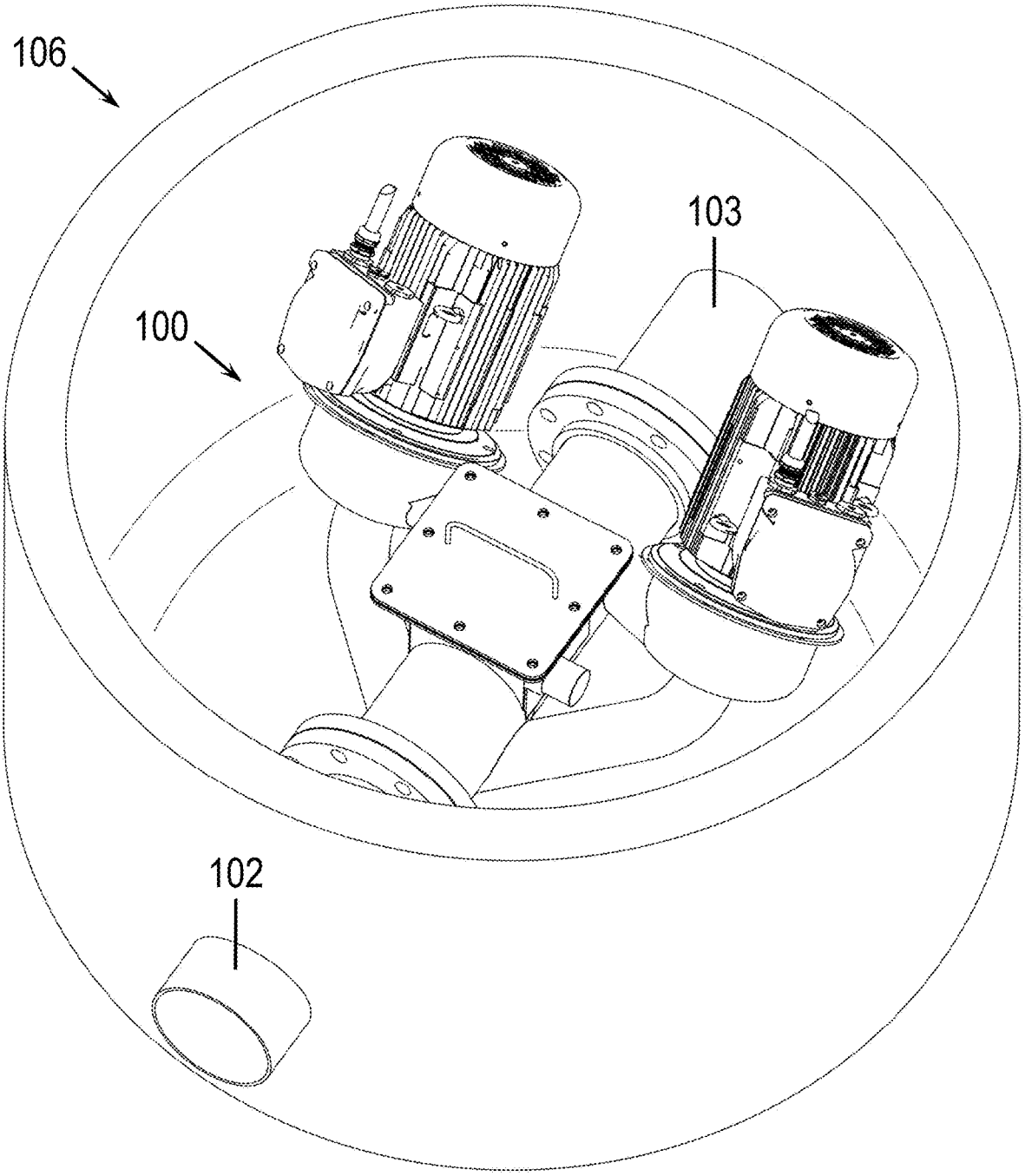
FIG. 5 is an environmental view in which the liquid pumping apparatus is installed in a dry well of a wastewater network.
Figure 6:
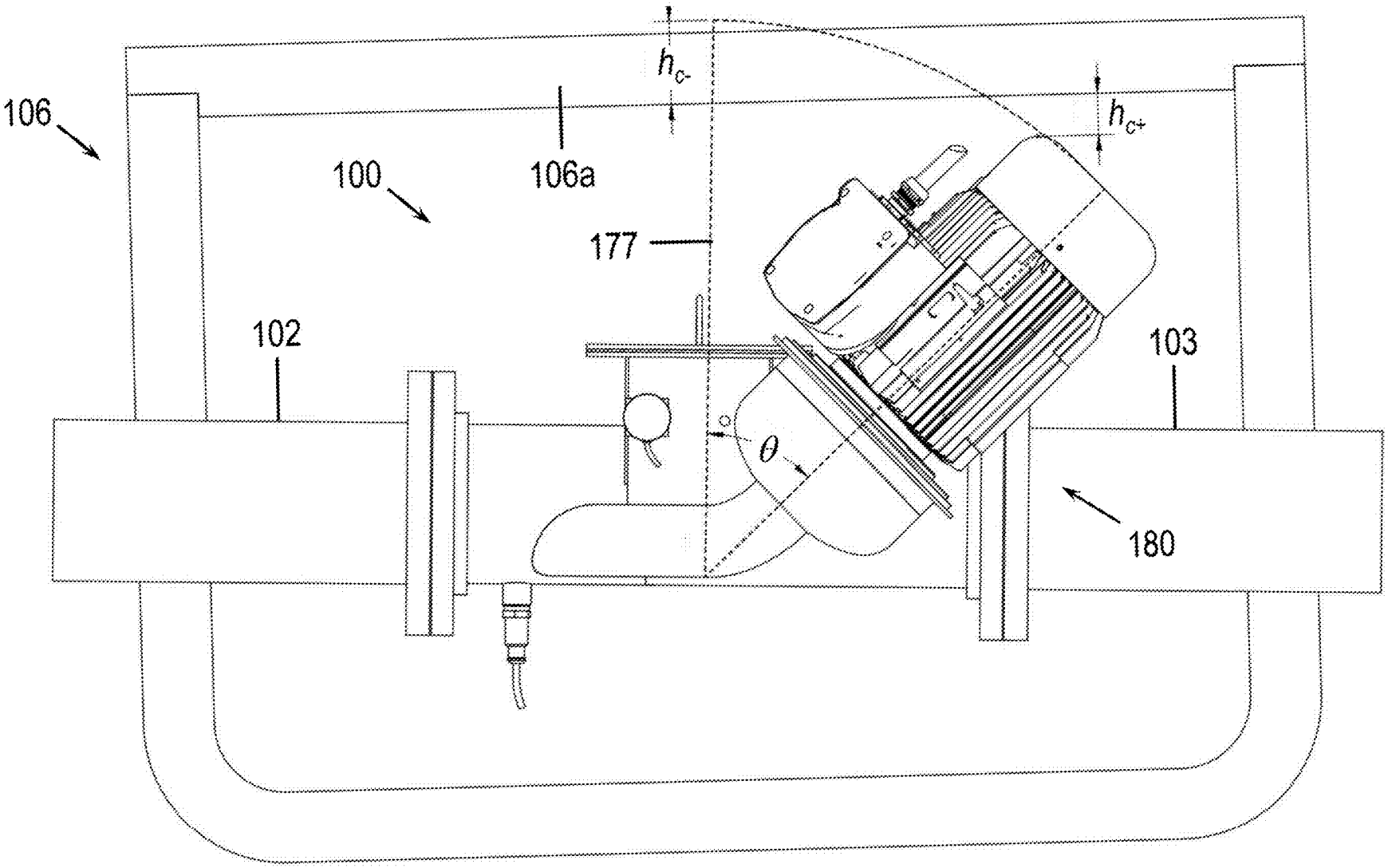
FIG. 6 is a side view of the liquid pumping apparatus, system, and method in which the liquid pumping apparatus is installed in a dry well of a wastewater network.

According to the invention, a direct in-line liquid pumping apparatus and system 100 can be formed that is suitable for municipal, commercial, and/or industrial wastewater applications. Such a direct in-line pumping system 100 advantageously eliminates a need for wet wells by pumping gravity fed effluent directly from the point of ingress to the point of egress in the gravity feed network 101. The liquid pumping apparatus 100 may be installed in a shallow dry well 106 environment, such as the arrangement illustrated in FIGS. 5 and 6. In FIG. 5 the liquid pumping apparatus 100 may be seen coupling the inlet 102 pipe to the outlet pipe 103, both of which penetrate the wall of the dry well 106. FIG. 6 illustrates a section view of the direct in-line liquid pumping apparatus, system, and method 100 where the mechanical clearances are evident. The dry well lid **106*a* is included in this view to illustrate another feature of the present invention 100. The one or more pumps 180, including the pump bodies 174 and motors 170, may be disposed at an angle, θ, with respect to a vertical axis 177 orthogonal to the flow direction 104. This may create positive clearance, $h_{c+}$, with respect to the lid 160*b*. The dashed lines illustrate the case where the pumps 180** are oriented vertically, i.e.

parallel to the orthogonal axis 177. In this case, a negative clearance, $h_{c-}$, may appear, that is, the pumps 180 may interfere with the lid 160*b*. The angled pump orientation advantageously allows the present invention to be installed in shallow dry wells within gravity feed networks, and is especially advantageous for retrofit applications.

While certain configurations of structures have been illustrated for the purposes of presenting the basic structures of the present invention, one of ordinary skill in the art will appreciate that other variations are possible which would still fall within the scope of the appended claims. For example, other variations can be made to the invention including adding of devices to accelerate the velocity-flow of a gravity channel with counter-slopes along its trajectory or path, or of a filled fluid channel. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A system for pumping wastewater flowing in a gravity feed network having in-line inlet and outlet pipes, comprising:

a main pipe coupled to the inlet pipe and the outlet pipe of the gravity feed network, the main pipe configured to receive wastewater flow, the main pipe comprising an upstream portion, a downstream portion, and a manifold disposed therebetween, wherein the main pipe includes a vertical axis orthogonal to the flow direction;

one or more branch lines, each branch line including:

a pump of the reversible, self-clearing type having a pump body, and a motor operably coupled to an impeller operating in a forward direction to increase the flow of wastewater, wherein the pump is disposed at an angle with respect to the vertical axis;

an inlet branch pipe coupled to a first end of the upstream portion, and at a second end thereof to the pump body;

an outlet branch pipe coupled at a third end to the pump body and at a fourth end to the downstream portion;

a check valve operably disposed in the manifold portion, the check valve having a closed first position and an open second position, wherein the check valve in the closed first position is adapted to prevent upstream flow, and in the open second position, to allow downstream flow through the main pipe;

at least one sensor adapted to determine the wastewater level in the main pipe; and at least one sensor adapted to determine a deflection angle of the check valve;

wherein the system is controllably adapted to increase the flow of the wastewater when the wastewater level in the main pipe is above a predetermined level.

2. The system according to claim 1, further comprising a variable frequency drive adapted to operate each branch line pump of the one or more branch lines.

3. The system according to claim 1, further comprising one or more closure members secured by one or more flanges disposed on the upstream portion and/or the downstream portion.

4. The system according to claim 3, the one or more closure members are selected from the group consisting of: a gate valve, a ball valve, and a shutter valve.

5. A system for pumping wastewater flowing in a gravity feed network having in-line inlet and outlet pipes, comprising:

a main pipe coupled to the inlet pipe and the outlet pipe of the gravity feed network, the main pipe configured to receive wastewater flow, the main pipe comprising an upstream portion a downstream portion, and a manifold disposed therebetween, wherein the main pipe includes a vertical axis orthogonal to the flow direction;

one or more branch lines, each branch line including:

a pump of the reversible, self-clearing type having a pump body, and a motor operably connected to an impeller operating in a forward direction to increase the flow of wastewater;

an inlet branch pipe connected at a first end to the upstream portion, and at a second end to the pump body;

an outlet branch pipe connected at a third end to the pump body and at a fourth end to the downstream portion;

a check valve operably disposed in the manifold portion, the check valve having a closed first position and an open second position, wherein the check valve in the closed first position is adapted to prevent upstream flow, and in the open second position, to allow downstream flow through the main pipe;

at least one sensor adapted to determine the wastewater level in the main pipe;

at least one sensor adapted to determine a deflection angle of the check valve;

a controller electrically connected to the sensors and adapted to increase the flow of the wastewater when the wastewater level in the main pipe is above a predetermined level;

wherein the system is controllably adapted to increase the flow of the wastewater when the wastewater level in the main pipe is above a predetermined level.

6. The system according to claim 5, further comprising a variable frequency drive adapted to operate each branch line pump of the one or more branch lines.

7. The system according to claim 5, further comprising one or more closure members secured by one or more flanges disposed on the upstream portion and/or the downstream portion.

8. The system according to claim 7, the one or more closure members are selected from the group consisting of: a gate valve, a ball valve, and a shutter valve.

* * * * *